United States Patent [19]

Suesada et al.

[11] Patent Number: 5,020,479

[45] Date of Patent: Jun. 4, 1991

[54] WATERTUBE BOILER AND ITS METHOD OF COMBUSTION

[75] Inventors: Yasuhiko Suesada; Takashi Moriyama; Junichi Sugioka; Hiroshi Tahara, all of Osaka, Japan

[73] Assignees: The Kansai Electronic Power Company Inc.; Hirakawa Iron Works, Ltd., both of Osaka, Japan

[21] Appl. No.: 400,053

[22] Filed: Aug. 29, 1989

[30] Foreign Application Priority Data

Sep. 10, 1988 [JP] Japan ..... 63-227181

[51] Int. Cl.[5] ..... F22B 15/00

[52] U.S. Cl. ..... 122/235.11; 122/235.23; 122/136 R

[58] Field of Search ..... 122/235 R, 235 K, 247, 122/249, 136 R

[56] References Cited

U.S. PATENT DOCUMENTS

| | | | |
|---|---|---|---|
| 1,683,046 | 9/1928 | Murray | 122/235 K |
| 1,975,503 | 10/1934 | Engler | 122/235 P |
| 2,656,157 | 10/1953 | Wasielewski | 122/235 R |
| 2,674,981 | 4/1954 | Clarkson | 122/136 R |
| 3,247,830 | 4/1966 | Vogler | 122/235 R |
| 3,675,629 | 7/1972 | Stevens | 122/235 R |
| 3,810,447 | 5/1974 | Grainger | 122/136 R |
| 4,044,727 | 8/1977 | Rychen et al. | 122/249 |
| 4,245,588 | 1/1981 | Gill et al. | 122/235 K |
| 4,421,065 | 12/1983 | Tillequin | 122/136 R |

FOREIGN PATENT DOCUMENTS

| | | | |
|---|---|---|---|
| 1136849 | 1/1957 | France | 122/235 K |

*Primary Examiner*—Henry A. Bennett
*Assistant Examiner*—Denise L. Gromada
*Attorney, Agent, or Firm*—Wenderoth, Lind & Ponack

[57] ABSTRACT

A watertube boiler for all types of boilers including natural circulation, forced circulation and one-through types. The boiler includes a plurality of heat absorption water tubes forming a heat absorption watertube unit in the furnace. The heat absorption watertube unit comprises a relatively dense arrangement of heat absorption water tubes disposed in the combustion path of the burner, such that the flame of the burner impinges on the unit. The heat absorption watertube unit can be arranged in the first stage of a watertube boiler having at least one additional furnace stage receiving exhaust gas from the first stage. The additional stage can be disposed either perpendicularly and horizontally, and the air/fuel mixture in each stage is maintained at a specificied ratio to optimize combustion of the fuel. A method of operating a watertube boiler having three stages is also provided. By using the watertube boiler and method, the generation of nitrogen oxides can be controlled and the volume of the boiler can be reduced.

6 Claims, 10 Drawing Sheets

FIG. 9(A)
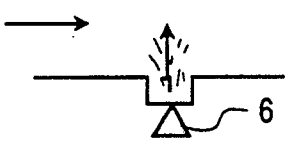
FIG. 9(B)
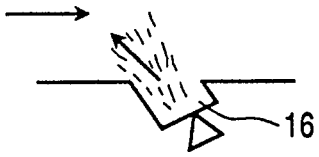
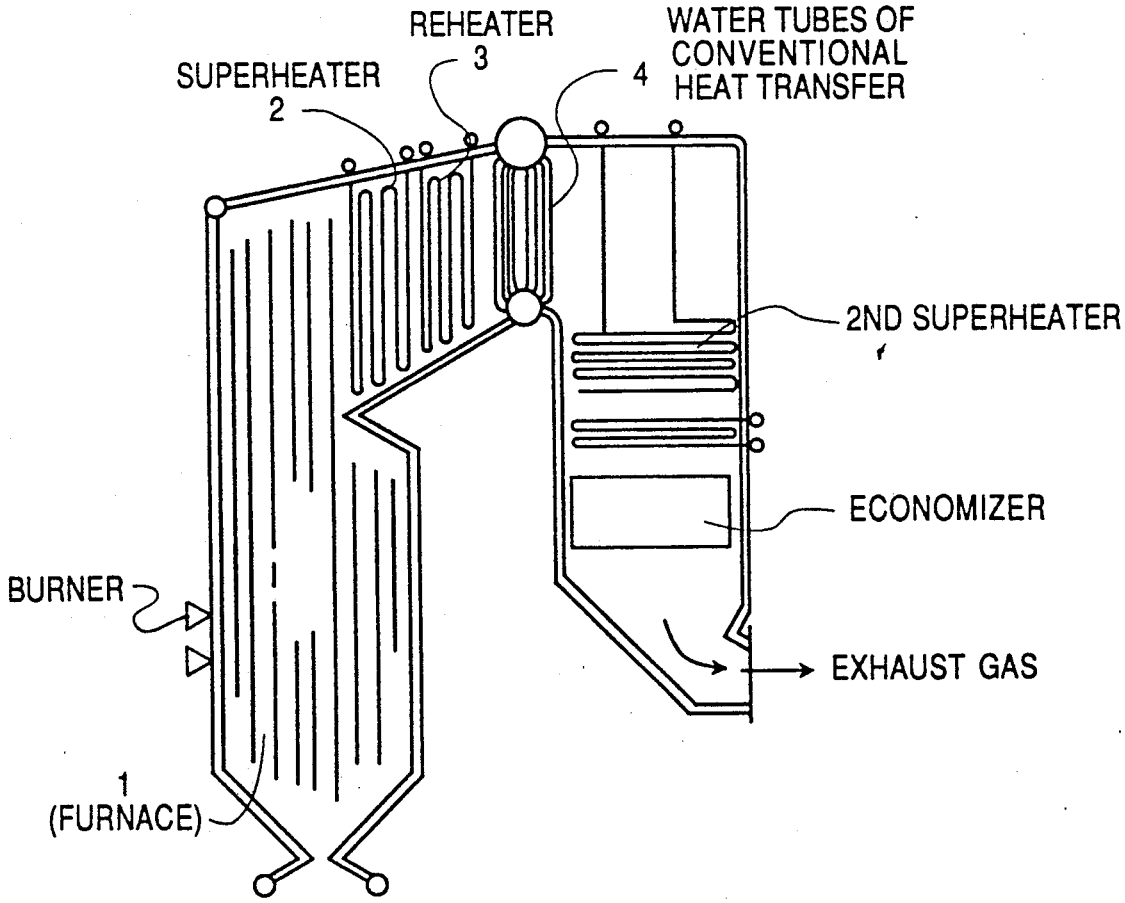
FIG. 10
PRIOR ART

WATERTUBE BOILER AND ITS METHOD OF COMBUSTION

BACKGROUND OF THE INVENTION

Formally the furnace of a boiler covers the largest capacity structurally of boiler and controls the quality and the cost of the boiler greatly, and so miniaturization of the furnace of a boiler has been desired.

FIG. 10 shows a diagrammatic representation of a sectional view of a conventional watertube boiler.

In FIG. 10, (1) designates a furnace, (2) designates a secondary super heater, (3) designates a reheater and (4) designates a watertube boiler. The furnace (1) covers about 10% of a boiler as a heating surface which is not so large, but the occupied volume itself covers about 60% of the boiler.

This fact is due to the small heat liberation rate in a furnace, for example the value of heat liberation rate is only to the extent of about 100,000 Kcal/m$^3$H, even in a large scale capacity boiler for power generation and industry, etc. The reason for this is due to the fact that in such a boiler as a conventional boiler in which the water-wall tubes surround the large combustion flame, the heat absorption rate of the heating surface becomes larger of its own accord in proportion to the heat liberation rate in the furnace and the water tubes of a boiler are finally burnt out which brings about the so called "burn-out phenomenon".

This burn-out phenomenon is due to the fact that the heat liberation rate in the furnace of a boiler should be small in order to maintain a suitable heat absorption rate of the heating surface of a boiler, because the water-wall heating surface of a boiler is proportional to the 2nd power of its dimension against the increase of the volume of a boiler in proportion to the 3rd power of its dimension from the point of the similarity of combustion and conduction of heating according to the capacity of a boiler.

Therefore, a large space is necessary for the furnace of a large capacity boiler for power generation and industry, etc. and so accordingly the boiler has become large sized.

FIG. 11 shows a diagrammatic representation of a furnace of a conventional watertube boiler. In FIG. 11, (1) designates a furnace, (5*a*) designates a water-wall tube of the furnace. FIG. 12 illustrates the distribution of a heat flux of water-wall tube in the furnace of a conventional watertube boiler.

As shown in FIG. 12, water-wall tubes (5*a*) are given a radiation heat transfer (QoKcal/m$^2$H) from the combustion flame, which is a characteristic of water-wall tubes of a furnace of a conventional watertube boiler.

This radiation heat transfer is only given from the hemisphere side (7) of the furnace, but not from the hemisphere (8) of the wall side of the furnace, i.e. the hemisphere of wall side (8) of a furnace does not contribute to the heat transfer.

There is a distribution of the value of heat flux on the hemisphere side (7) of the furnace as shown by the arrows in FIG. 12. In that case, it is necessary to make the maximum value of heat flux below the critical heat flux so as not to cause a burn-out phenomenon and so there were points to be considered in design that the sum of local heat absorption rate at the circumference of a watertube of a conventional furnace should be very low. Formally, there were plans to raise the critical heat flux in order to solve the above mentioned points. For example, inner grooved water tubes were tested for use but did not succeed to raise remarkably the heat liberation rate so as to obtain a noticeable effect in the furnace.

On the other side, when the heat liberation rate in the furnace is raised, it has a defect of causing pollution because hot spots are generated in the central part of the conventional furnace and large amount of a nitrogen oxide (NOX) are exhausted in such a condition as is existed as the lumped flame in the conventional furnace. In order to suppress the critical heat flux and the amount of NOX, the furnace of a boiler cannot be made small if it is within a conventional boiler.

And, in order to exceed the limit of a boiler heretofor in use, it is necessary to adopt such a novel watertube boiler as the one in which the critical heat flux is exceedingly high, and which enables to produce high intensity combustion and to produce the low amount of NOX under high intensity combustion.

SUMMARY OF THE INVENTION

The present invention aims to produce a watertube boiler having a furnace inserted heat absorption water tube which controls the generation of NOX under high intensity combustion, which keeps the local heat flux below the critical value, and moreover which reduces the volume of the boiler. The furnace of the present invention is extremely smaller and lighter than that of the conventional boiler.

Thereby, the present invention is to provide a method of combustion of the above described watertube boiler.

In the present invention, in the natural circulation type boiler or the forced circulation type boiler or the once-through boiler, the furnace is made extremely small by arranging many heat absorption water tubes in the single furnace connecting adjacent to the burner which ignites the fuel, and so the flame temperature is suppressed to attain the low NOX concentration, and moreover the heat transfer by convection is accelerated.

And moreover from the problems of design, to make the boiler large sized and reduce the concentration of NOX in the exhausted gas, etc, furnace inserted absorption water tubes are provided multi-staged and by changing the air ratio in each stage of the multi-staged furnace, air rich combustion and fuel rich reduced combustion are properly combined. An ordinary proper air ratio is obtained at the last stage of combustion and a complete combustion is attained. Therefore, a better result to reduce NOX is obtained than by a single combustion system boiler.

The method of combustion described above brought about the same effect which is obtained by using the said single furnace inserted heat absorption water tube, having either a single or a multiple number of burners of a boiler.

BRIEF DESCRIPTION OF THE DRAWINGS

FIG. 9 is an illustration of the direction of a burner on (16) and after the 2nd stage (16).

FIG. 10 is a diagrammatic representation of a sectional view of a conventional watertube boiler.

FIG. 14-B is an illustration of the heat absorption watertubes of the watertube boiler of the present invention arranged in a staggered arrangement.

FIG. 15-B is an illustration of a heat absorption watertube of the watertube boiler of the present invention having fins in the inner surface of the watertube.

Figure 1:
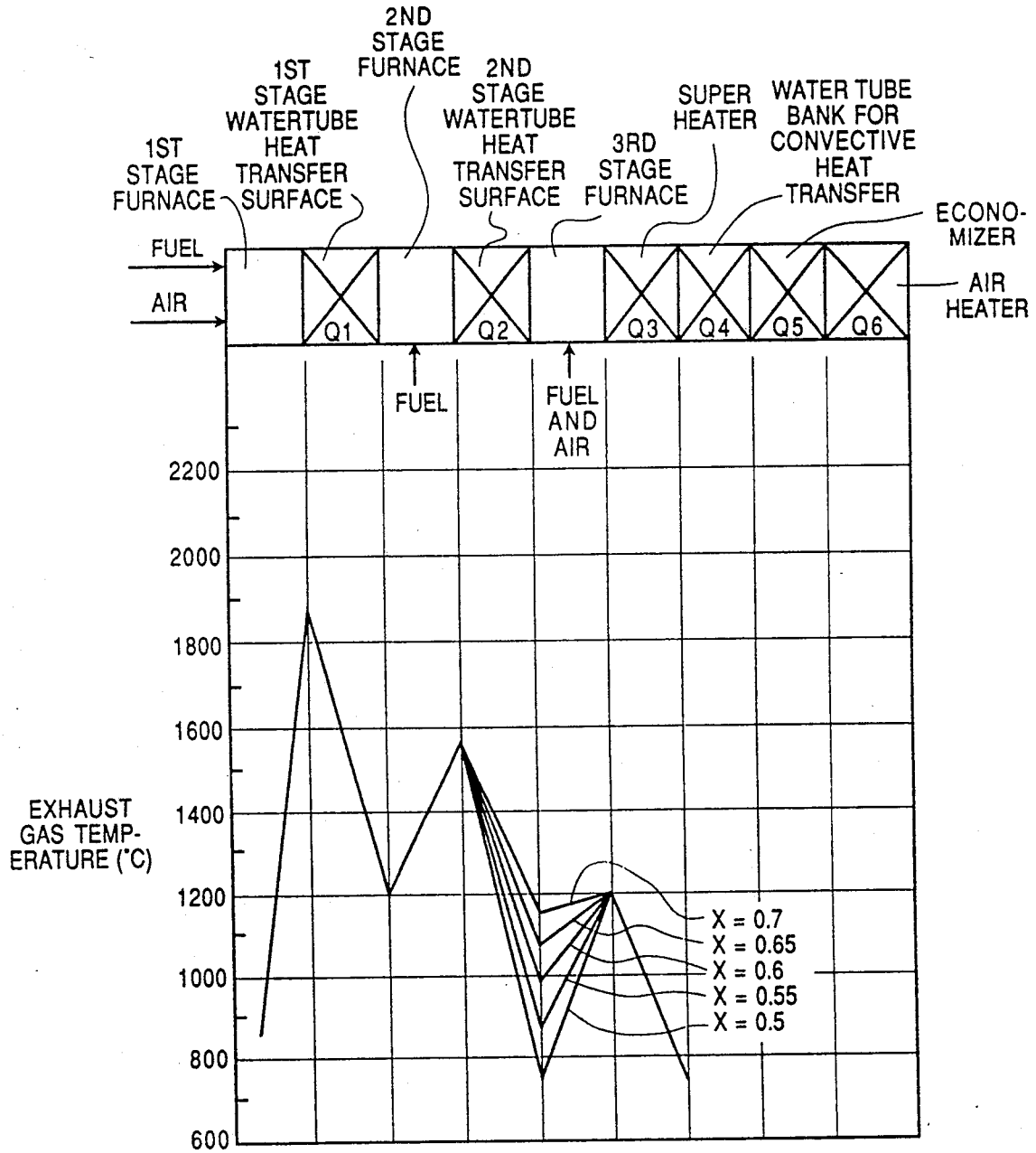
FIG. 1 is a diagrammatic representation of the flow of fuel and air and the temperature of exhausted gases in a 3-stage tandem boiler in accordance with the present invention.

A represents a conventional boiler which has no heat absorption water tube in the furnace.

B represents an example of the present invention which has heat absorption water tubes in the furnace.

In the drawings, 1 shows a furnace, 5*a* shows the water tubes of a furnace. 5*b* shows the heat absorption water tubes inserted in the furnace. 6 and 16 show a burner. 7 shows the furnace side of water-wall tubes. 8 shows the furnace wall side of water-wall tubes of a furnace. 9 shows the heat transfer by convection. 10 shows the heat transfer by radiation. 11 shows the 1st-stage furnace. 12 shows the 2nd-stage furnace. 13 shows 3rd-stage furnace.

DETAILED DESCRIPTION OF THE INVENTION

As to a combustion method of supplying a boiler with fuel and air in the furnace inserted heat absorption water tube of the present invention, for example, furnaces inserted heat absorption water tubes are arranged in 3 stages in tandem. By the air rich combustion of excess air the ratio (air/fuel$\approx$1.25) is surpressed the NOX produced rapidly, i.e. so called prompt NOX in the 1st stage, and fuel rich combustion is taken place and the NOX is reduced by the combustion of a fuel only or the fuel mixed with a small amount of air under the air/fuel$<$1 in the 2nd stage, and the method of combustion is taken place in order to make air/fuel$\approx$1.05 the reasonable excess air amount in the 3rd stage.

And this method of combustion is fitted to the whole arrangement and effect.

The whole heat balance and temperature of each part are shown in FIG. 1.

In this case, it is ascertained to be effective that the amount of combustible fuel of 1st stage to the whole amount of combustible fuel (saying 1st stage fuel consumption rate X) is made about 50$\sim$70%.

According to the trial calculation of the inventors of the present invention, it is impossible to exceed the 1st stage fuel consumption rate (X) over 70% from the mass balance and if the 1st stage fuel consumption rate X is lower than the 50%, heat transfer of 2nd stage heat absorption water tubes is disadvantageous due to the fact that the temperature in the outlet of the 2nd stage drops too much.

As for the conventional watertube boiler, the plans to diminish stepwise the ratio of fuel and air described above were tested, but these were not successful.

The present invention is characterized by accelerating the heat transfer by convection and by controlling the flame temperature by arranging the many heat absorption water tubes densely without making hot spots of the flame even in a single furnace.

This construction of a furnace can raise remarkably the heat liberation in the furnace and at the same time it can be also acted advantageously to diminish the amount of NOX. According to the results of the inventors' research of the present invention, the amount of NOX is reduced about more than 25% in the region of the O2 1.5$\sim$2.5% of the present invention as is illustrated by the line B of FIG. 13.

Figure 13:
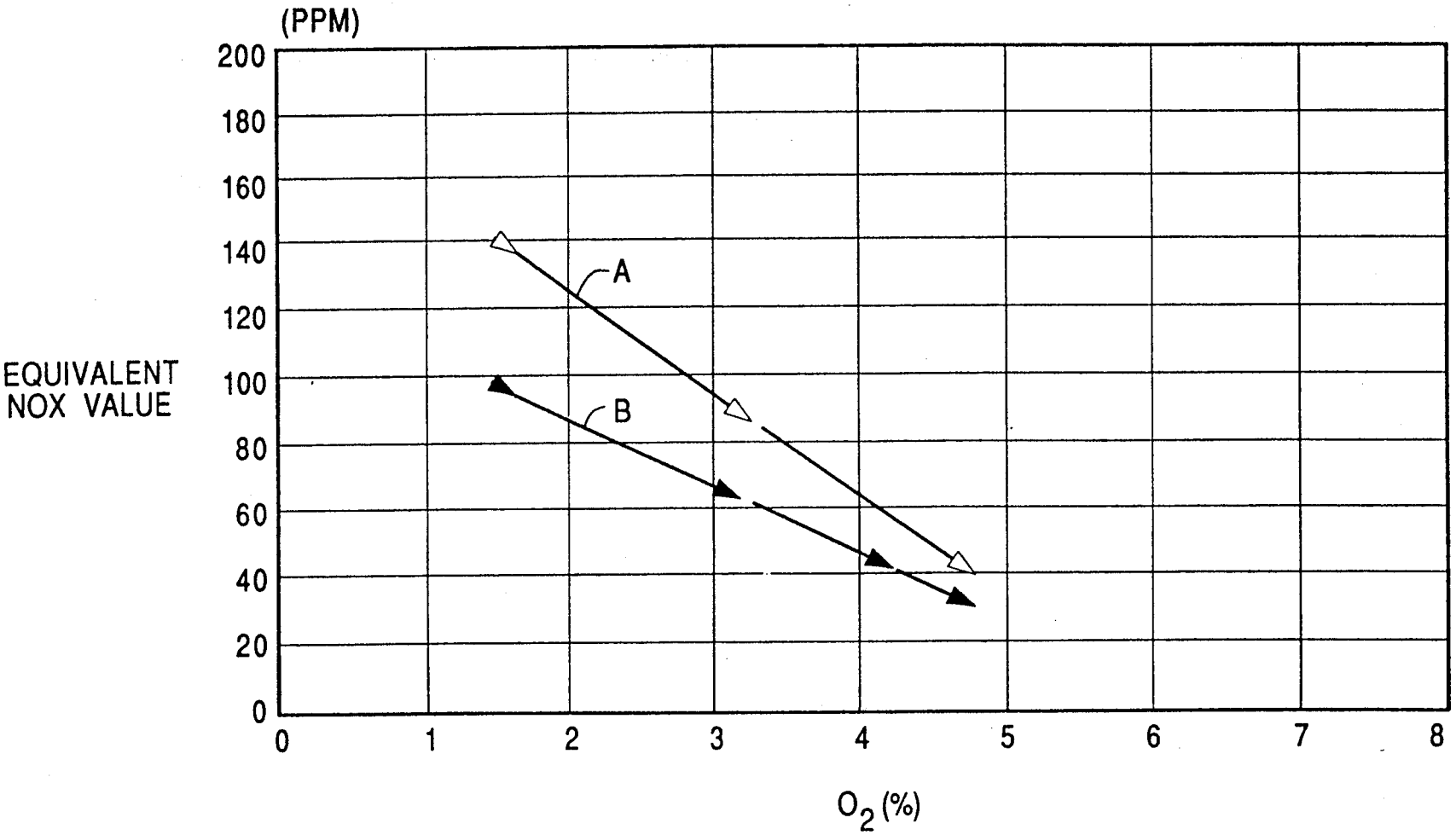
FIG. 13 is the illustration of a equivalent NOX value to the oxygen content in the exhaust gas of a premix burner.

The value of equivalent NOX in FIG. 13 is represented as follows:

$$\text{Equivalent } NOX = \frac{21 - O_2 \text{ Equivalent}}{21 - O_2 \text{ measured}} \times NOX \text{ measured}$$

Moreover, a multistaged furnace is characterized to arrange many heat absorption water tubes densely. At each stage of the furnace a combustion reaction is carried out stepwise at each stage which accompanying the heat removal at the same time.

The above-described method is also effective to a relatively better fuel, especially for gas fuel for example.

With respect to a conventional watertube boiler, the combustion method in which a flame impinges directly on the water tube has not been adopted because carbon monoxide (CO) and unburned components of the fuel are generated and a burning out of the water tubes often results. As a result of the fundamental research of the inventors of the present invention, it has been discovered that CO and the unburned components exist in a thin layer within 1 mm from the wall of a heat absorption water tube due to the quenching phenomenon, when the flame impinges on the heat absorption water tube.

It has also been confirmed that the CO and the unburned components are burnt and disappear if a gap of about more than 10 mm is provided between each heat absorption water tube. CO especially diminishes remarkably in the heat absorption chamber on the side of the water tubes opposite the flame.

Figure 14A:
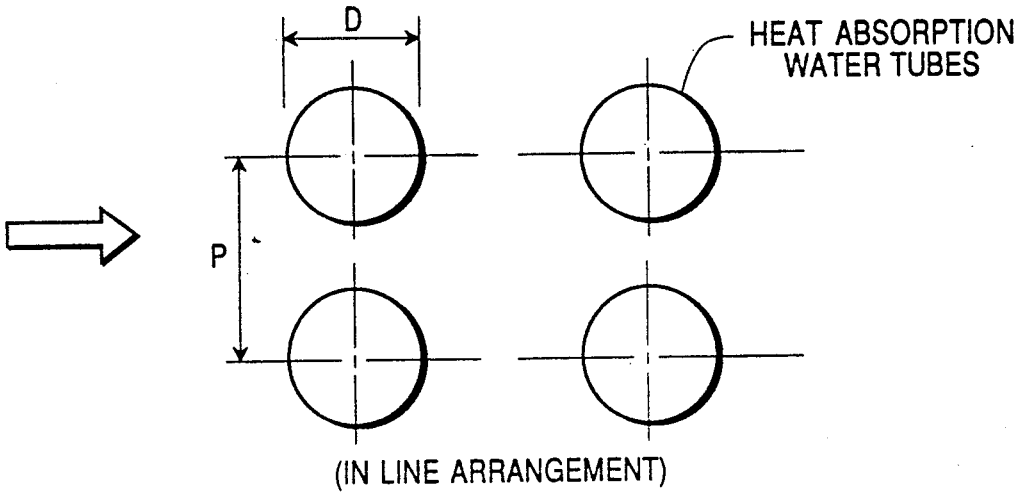
FIG. 14-A is an illustration of the heat absorption watertubes of the watertube boiler of the present invention arranged in an in-line arrangement.
Figure 14B:
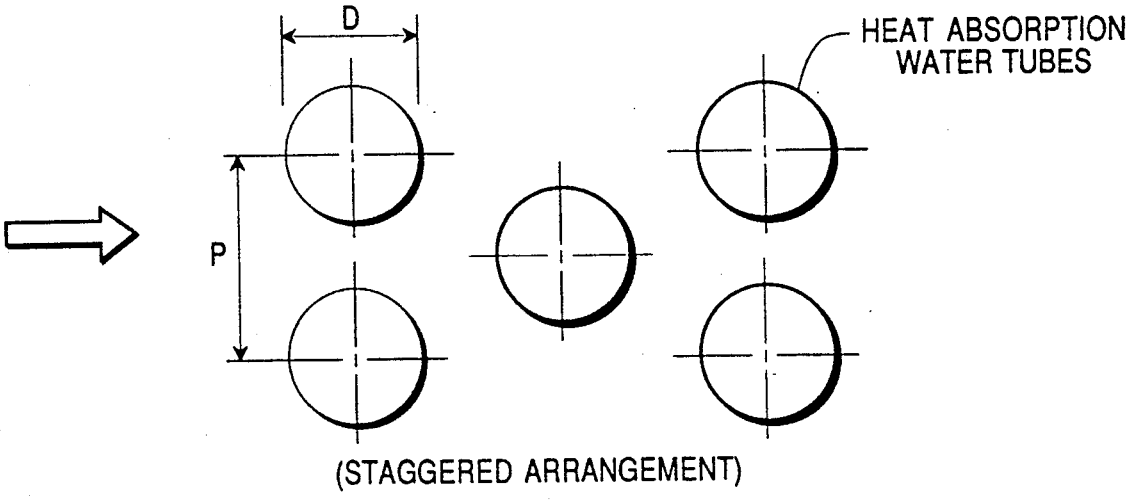

From the result of the research of the inventors of the present invention, the heat absorption water tubes rather accelerate the combustion and the distance from the burner head to the distance of the disappearance of $CO_2$ (length of the flame) is too short in the case when heat absorption water tubes exist. In this case, the arrangement of the heat absorption water tubes have a larger effect in a staggered arrangement (FIG. 14-B) than an in-line arrangement (FIG. 14-A).

And moreover, the heat absorption water tubes in the flame of the furnace of fuel receive nearly equal heat transfer by radiation, but the effective thickness of the gas layer of radiation is far smaller than the conventional furnace, and so the above described heat transfer rate is not so large as compared to the furnace of the conventional type, and heat transfer by convection caused by the flow of gases is rather large.

Figure 2:
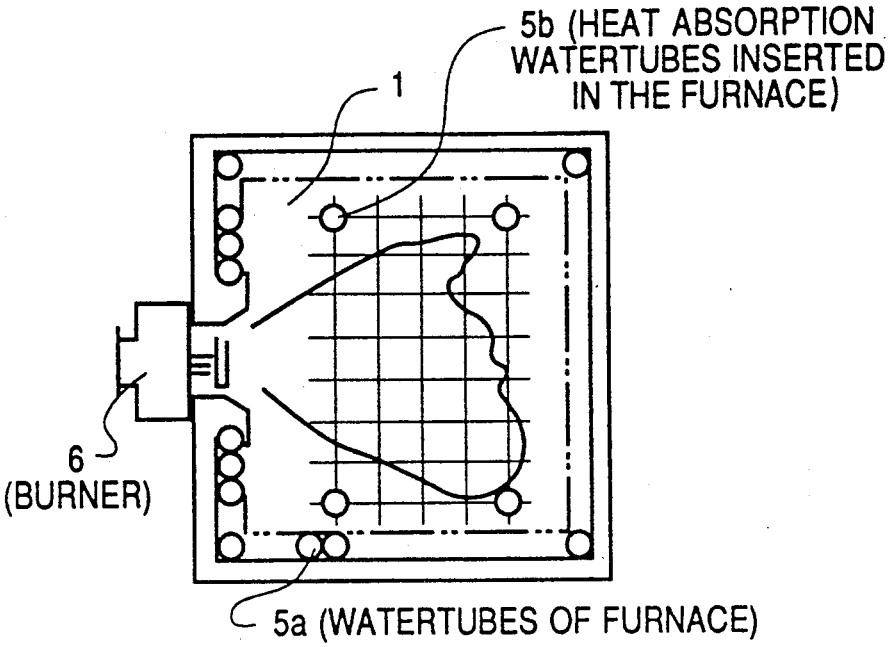
FIG. 2 is a view of the example of a furnace containing inserted heat absorption water tubes having a single or 2 or 3 stage furnace.

The construction of the furnace of the boiler of the present invention is shown in FIG. 2. Distribution of heat absorption rate of a heating surface (5*b*) around the furnace inserted heat absorption water tube in FIG. 2 is shown in FIG. 3.

Figure 3:
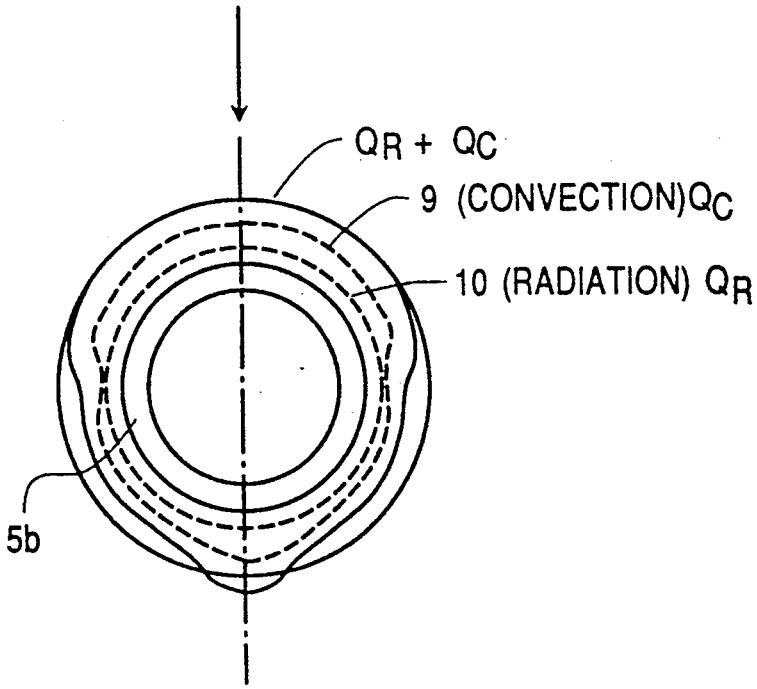
FIG. 3 is an illustration of the heat flux distribution of a furnace inserted heat absorption water tube.

In FIG. 3, (9) indicates the amount of heat convection (QC), (10) indicates the amount of heat of radiation (QR) and the total heat flux (QR+QC) is lower than the critical heat flux and almost equal around the circumference.

Moreover, a space is made by leaving out a small number of the heat absorption water tubes near the burner head in order to carry out the combustion more smoothly according to the burner characteristics.

And the air rich combustion or the reduced combustion by the fuel rich combustion can be caused locally in the same furnace space. As to the arrangement of the heat absorption water tubes in the furnace inserted heat absorption water tubes, it is necessary to run a speedy flow speed of a flame and the combustion gas to a certain extent among the heat absorption water tubes or it is necessary to run a flow speed lower to a certain extent among the heat absorption water tubes for the characteristic of heat intensity in the section of a combustion area, and so the ratio of the pitch (P) to the diameter (D) of the water tube (P/D) is preferable to 1.1~2.0.

In case of the P/D value is lower than 1.1, the gas flowing speed around the water tube becomes quick, and pressure drop becomes large and the sectional area perpendicular to the flow direction which is necessary for suitable combustion is not obtained and also the combustion will be troubled, and in case of P/D is over 2.6, the gas flow speed becomes slow and the heat transfer efficiency does not become well, and at least it is impossible to miniaturize the furnace.

Figure 15A:
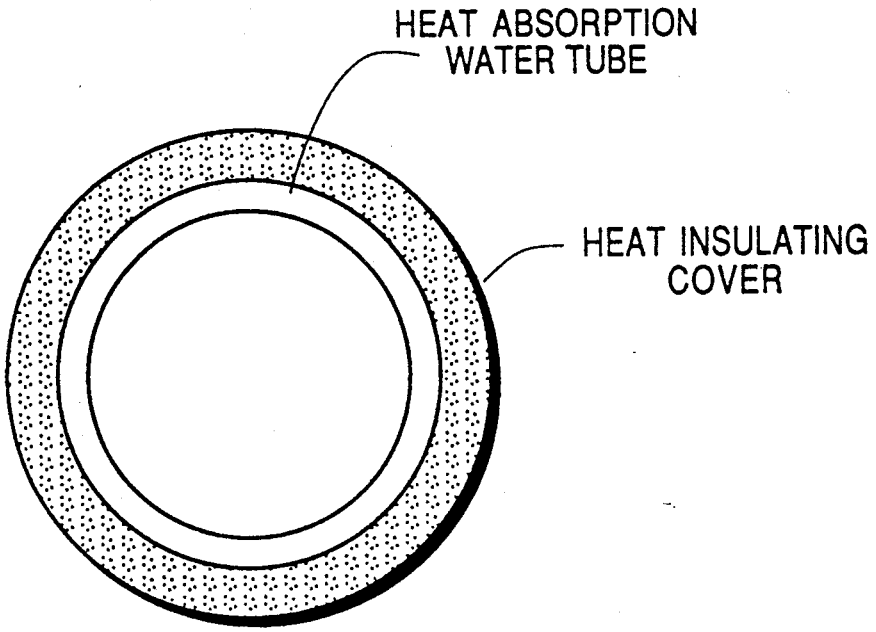
FIG. 15-A is an illustration of a heat absorption watertube of the watertube boiler of the present invention having a heat insulating cover.
Figure 15B:
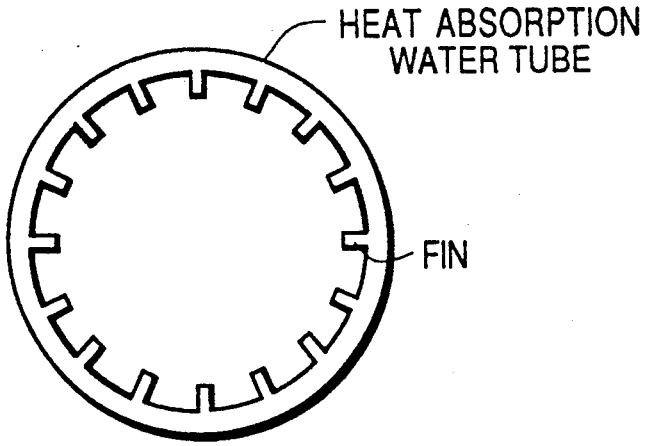

Moreover, as the characteristic of the burner, the heat insulators are prepared in the outer surface of water tube (FIG. 15-A) or the channels or the fins in its inner surface (FIG. 15-B) are prepared in the case of high flux of water tube and it is effective to prevent the burn out of the heat transfer surface. And, there is a problem how to mix well the fuel and air of the 2-stage burner or the 3-stage burner in the multi-stage furnace type boiler of the present invention. The combustion gas path is taken upward or downward or horizontal downstream from the 1st stage burner of the boiler of the present invention, but in this case the direction of the burner of the 2nd stage and after is prepared toward nearly the square crossing flow or the counter flow (FIG. 9).

And it is effective to prepare the main exhaust gas path area so as to maintain the ½~1/5 of the burner jet velocity of a each stage after the 2nd stage of the main exhaust gas to raise the capacity of the mixing of gases.

Then, the present invention will be exemplified by way of example with reference to the accompanying drawings.

FIG. 2 is a sectional view of a furnace inserted heat absorption water tubes.

Figure 4:
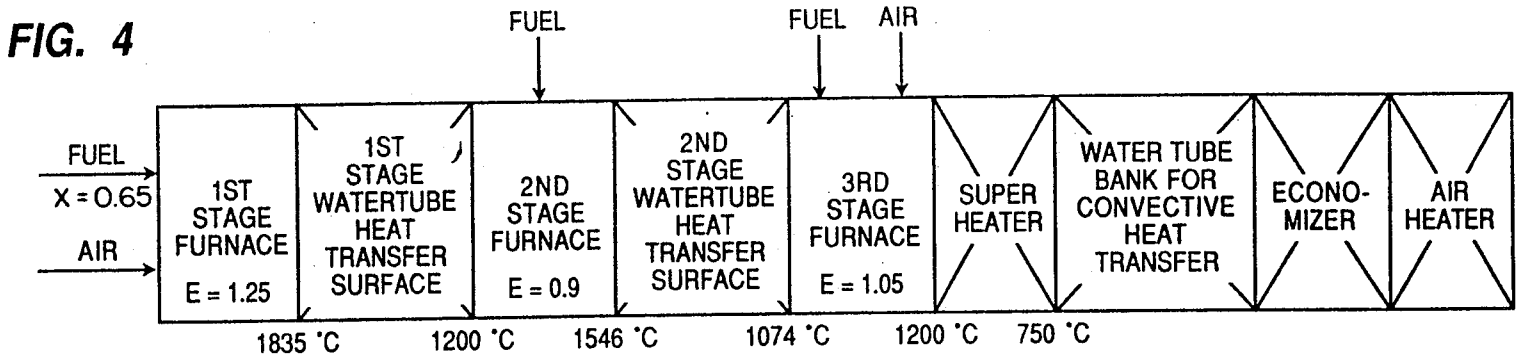
FIG. 4 is an illustration of the fundamental flow of fuel and air and the balance of the amount of heat in the furnace containing heat absorption water tubes in a 3-stage tandem arrangement.

FIG. 4 is an illustration of the fundamental flow of the 3rd stage furnace inserted heat absorption water tube arranged in tandem.

Figure 5:
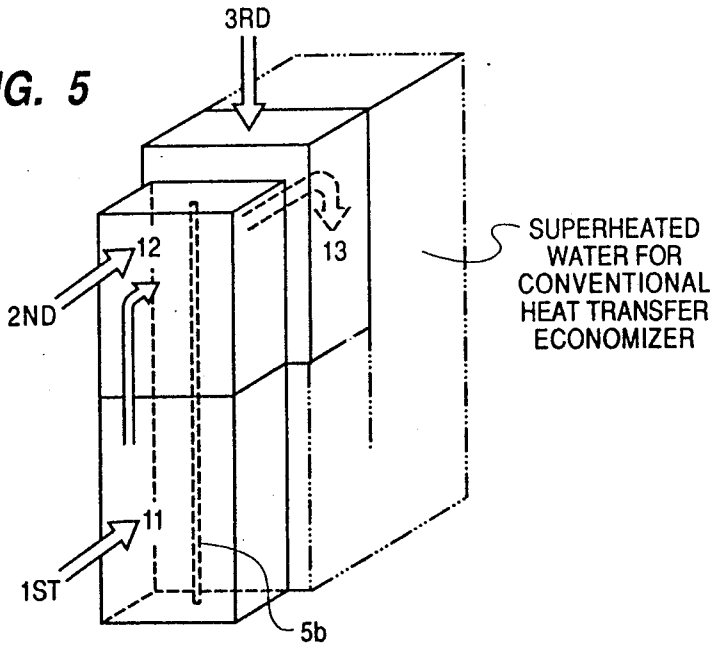
FIG. 5 is an illustration of a vertical flow of a vertical arrangement of a furnace.

FIG. 5 is an illustration of the flow of the vertical arrangement of the watertube boiler of the present invention.

Figure 7C:
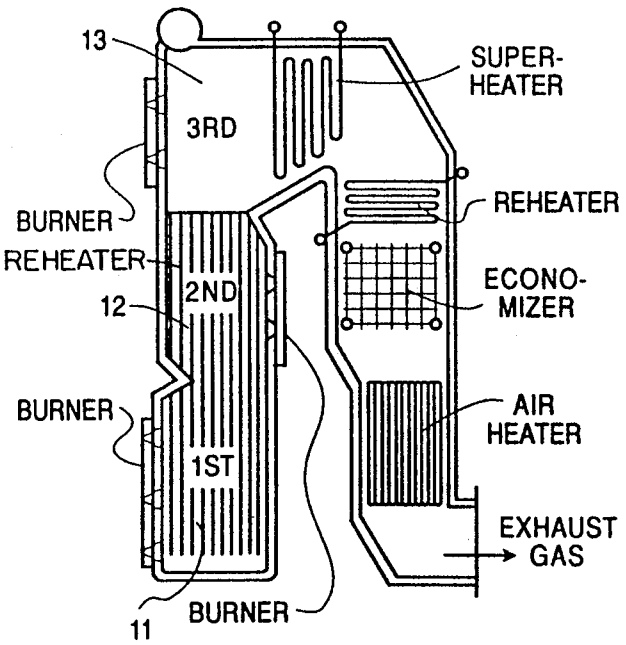
FIG. 7 (A), (B) and (C) are diagrammatic representations of sectional views of vertical arrangements of furnaces in 3-stage tandem boilers.
Figure 7B:
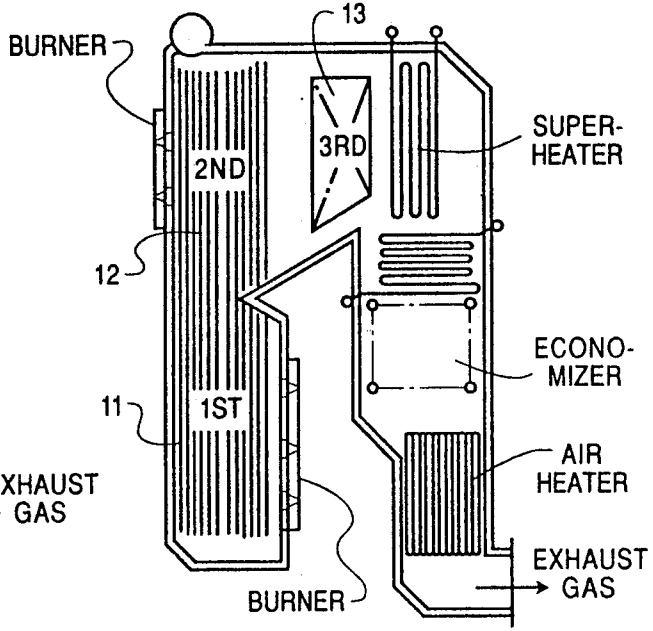
Figure 7A:
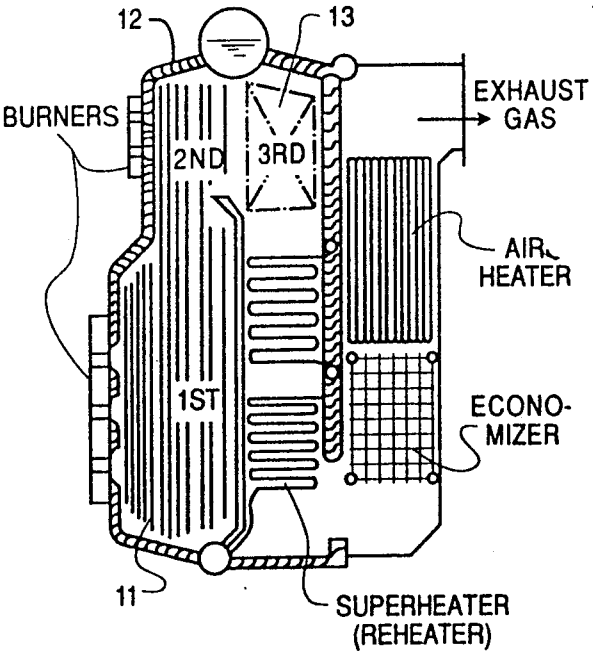
Figure 11:
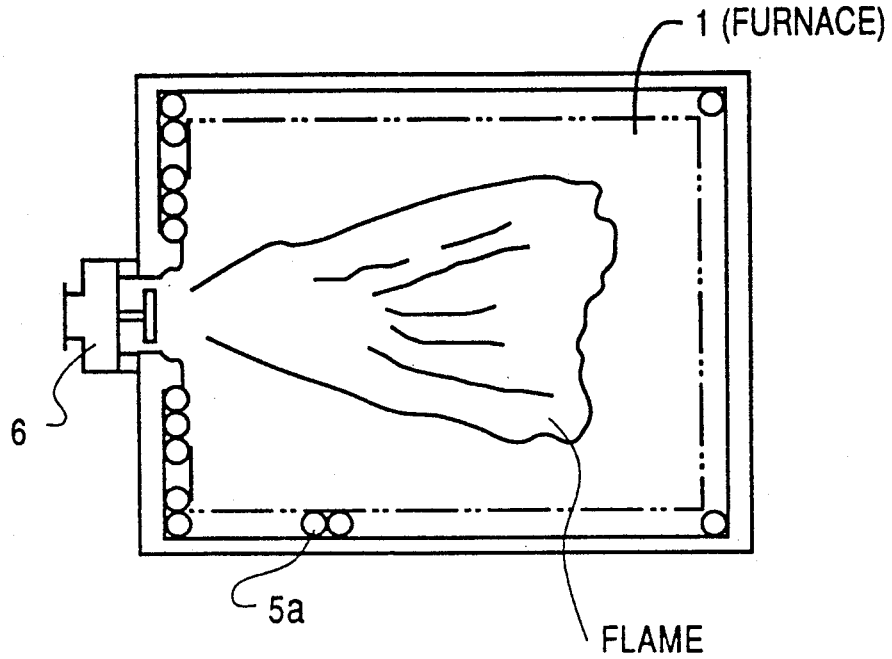
FIG. 11 PRIOR ART
FIG. 11 is a diagrammatic representation of a sectional view of the furnace of a conventional watertube boiler.
Figure 12:
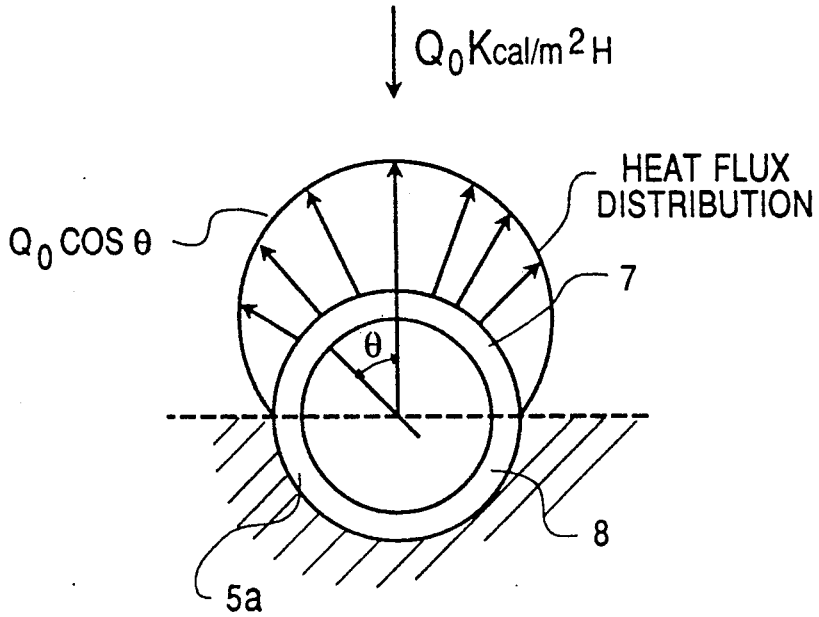
FIG. 12 is a view of a heat flux distribution of the water-wall tube in a conventional boiler.

FIG. 7 A, B and C each show a different sectional illustration in the case of the vertical arrangement as shown in FIG. 5.

Figure 6:
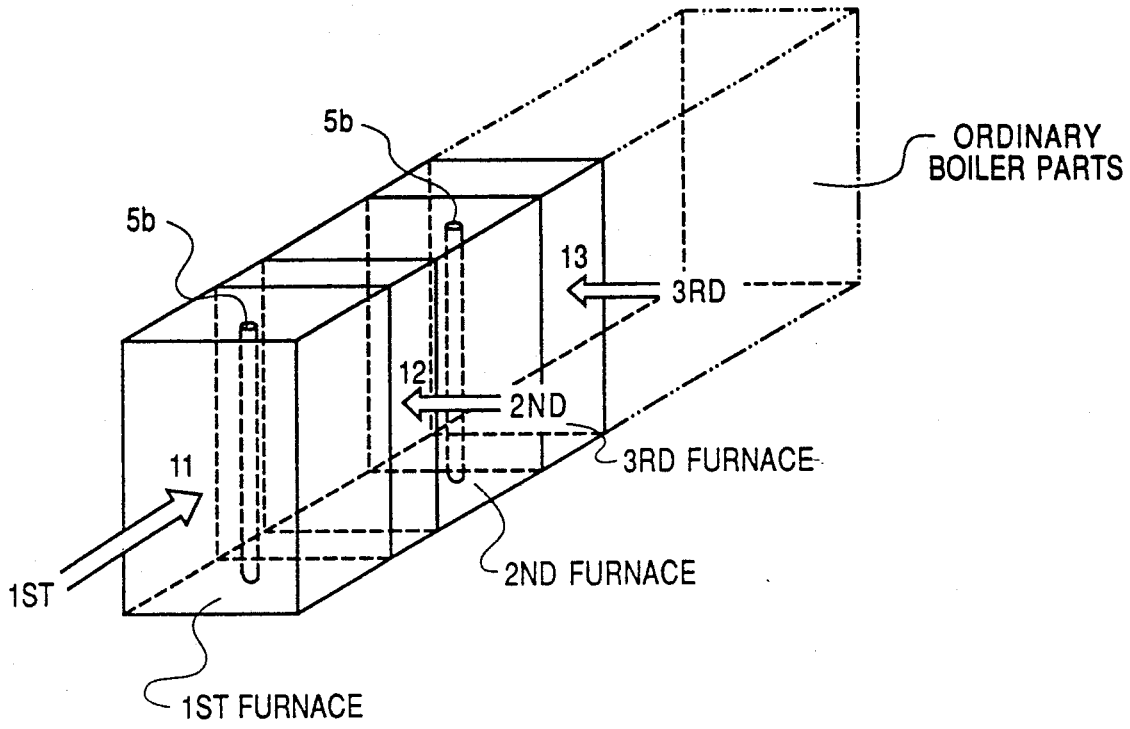
FIG. 6 is an illustration of a horizontal flow of a horizontal arrangement of a furnace.

FIG. 6 shows an illustration of the horizontal flow of the horizontal arrangements of a furnace.

Figure 8:
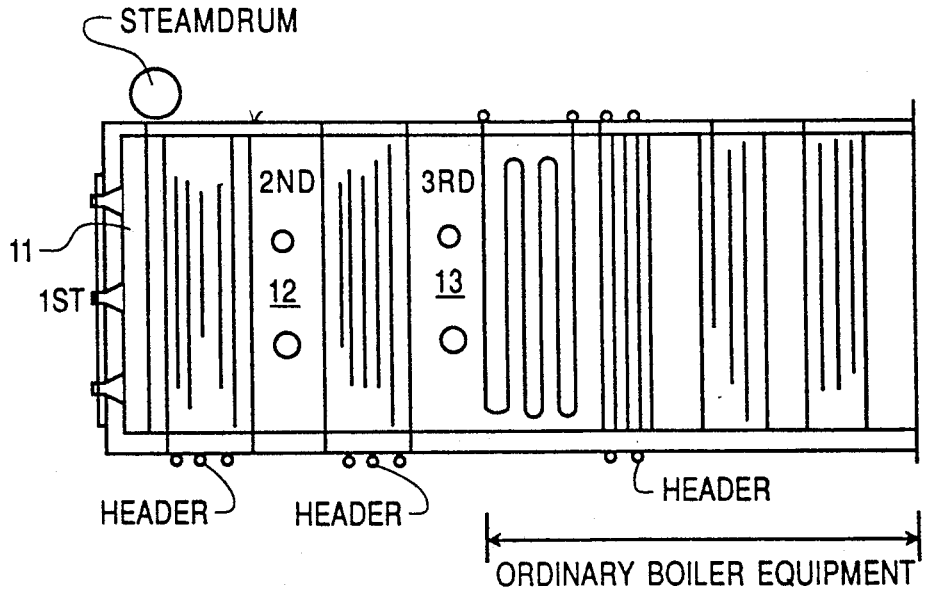
FIG. 8 is a diagrammatic representation of a sectional view of a horizontal arrangement of a 3-stage tandem boiler.

FIG. 8 shows a total sectional view of the horizontal arrangement illustrated in FIG. 6.

FIG. 9 shows the sectional views of the direction of a burner after 2nd stage.

In FIG. 1 and FIG. 4, the 1st stage and 2nd stage furnace have an outside diameter 50.8 mmϕ and a pitch 80 mmϕ and is jammed remarkably dense. As is shown in FIG. 4, 1st stage excess air ratio (E) is 1.25 and primary fuel consumption ratio (X) is 0.65 i.e. the 65% fuel of total amount of combustion is weakly ignited and at the same time, the generation of the prompt NOX and the thermal NOX are suppressed owing to that the temperature of the combustion gas lowers from 1,835° C. which is attained by an ordinary combustion chamber to 1,200° C. by heat removal of the heat absorption water tubes in the combustion reaction zone of the combustion chamber of the present invention.

The exhaust gas of 1,200° C. above described flows toward the down stream at the end of the 1st stage furnace, and is introduced to the 2nd stage furnace and crosses perpendicular with the 2nd stage burner jet (as referred to FIG. 5).

Only fuel is poured into the 2nd stage burner and excess air ratio (E) is lowered to 0.9 by mixing the fuel with the exhaust gas from the 1st stage and so the NOX produced at the 1st stage is reduced in the reducing combustion and the temperature of exhaust gas is lowered to 1,074° C. by the further heat removal. The exhaust gas from the 2nd stage furnace flows horizontally intact and fuel and air are poured into perpendicularly from the 3rd stage burner, and these exhaust gases are mixed soon and is obtained the optimum value of air ratio (E) and the temperature of the exhaust gas is raised to the optimum value of 1,200° C. and in this case, the water tubes are not inserted in the 3rd stage combustion tube, i.e. although 3rd stage furnace is at the oxidizing flame condition but the gas temperature is already lowered below 1,200° C. and in this case heat absorption water tubes are not inserted in the 3rd stage furnace as the amount of NOX is very low in the example of the present invention.

The exhaust gases are discharged from the boiler through superheater water tube bank for convective heat transfer, economizers and air heater similarly as the conventional boiler illustrated in FIGS. 1 and FIG. 4.

Further horizontal arrangement is illustrated in FIGS. 6 and 8 and the combustion gases flow horizontally and the furnace inserted heat absorption water tube of each stage is arranged horizontally.

In this case, the burners of 2nd and 3rd stage cross the exhaust gases at right angles or are devised more or less at an angle toward upstream as shown in FIG. 9.

In this case it is effective to raise the mixing condition of gases so as to make the path area the ½~1/5 of the burner jet velocity of the main exhaust gas stream after 2nd stage. And moreover, in case of the horizontal arrangement, it has a merit to construct simply the heat transfer elements of each stages as a panel-like at the place (factory) actually constructed.

The advantages of the present invention are summarized as follows: As a result of a combination of a single and multistage furnace different from the conventional style of the conventional furnace and adoptation of the furnace inserted heat absorption water tube the NOX exhausted from the boiler is decreased about over 25% and the volume of said furnace can be made smaller under 1/10~1/20 than the volume of the conventional furnace and it is succeeded to make the boiler volume smaller than about ½ of the conventional boiler and so it is possible to make a boiler small and light. And moreover, as to the water-wall tube of the conventional boiler the heat flux of heating surface is unequal and exposed partly to danger of over-heating, but in case of the furnace inserted heat absorption water tube, heat absorption rate of a heating surface is equal, and is designed the boiler below the critical heat flux and the reliability and safety of the boiler are raised. And in the case where each stage of furnace inserted heat absorption water tube is arranged horizontal, the heat transfer element of each stage is made as a panel-like, and can be constructed simply at the actual place of construction.

What is claimed is:

1. A watertube boiler, comprising:

a furnace having a heat absorption chamber;

a burner directed into said heat absorption chamber of said furnace for combusting air and fuel in a combustion path in said heat absorption chamber;

a plurality of furnace water tubes extending along the inside walls of said furnace; and a plurality of heat absorption water tubes forming a heat absorption watertube unit of said furnace extending through said heat absorption chamber, said unit having a relatively dense arrangement of said plurality of heat absorption water tubes, and said unit being disposed in said combustion path of said burner such that the flame of the burner will impinge on said unit.

2. The watertube boiler as set forth in claim 1, wherein:

said heat absorption watertube unit has a ratio of the pitch (P) of the heat absorption water tubes to the diameter (D) thereof defined by the following expression:

$$1.1 \leqq P/D \leqq 2.$$

3. The watertube boiler as set forth in claim 1, wherein:

each said heat absorption water tube has a heat insulating cover on the outside thereof and grooves or fins on the inside thereof.

4. The watertube boiler as set forth in claim 1, wherein:

said furnace and its heat absorption chamber are a first stage in said watertube boiler;

said watertube boiler has at least one additional furnace stage receiving exhaust gas from said first stage, each said additional stage being disposed one of perpendicularly and horizontally with respect to the preceding said stage, and each said additional stage having at least one burner disposed so as to have a combustion path at one of perpendicularly to and opposed to the direction of the flow of exhaust gas from the preceding said stage; and the area of flow of said exhaust gas after said first stage is such that the velocity of said exhaust gas is maintained at ½ to 1/5 of the velocity of the combustion gases of said burner of each subsequent stage.

5. A method of operating a watertube boiler having three stages arranged in series with respect to each other and operatively connected to receive exhaust gas from a preceding stage, each said stage having a furnace, at least one burner, and a plurality of heat absorption water tubes arranged in a relatively dense arrangement in said furnace, said method comprising the steps of:

supplying an air rich air/fuel mixture ratio in the first said stage and combusting said air rich air/fuel mixture;

reducing the air/fuel mixture ratio in the second said stage below a value of 1 by adding fuel and no more than a small quantity of air in proportion to the quantity of fuel added; and optimizing the air/fuel mixture ratio in the third said stage by supplying fuel and air.

6. The method of operating a watertube boiler as set forth in claim 5, wherein:

said furnace of said first stage burns 50 to 70% of the total amount of fuel in said three stages.

* * * * *

UNITED STATES PATENT AND TRADEMARK OFFICE

CERTIFICATE OF CORRECTION

PATENT NO. : 5,020,479

DATED : June 4, 1991

INVENTOR(S) : Yasuhiko SUESADA et al.

It is certified that error appears in the above-identified patent and that said Letters Patent is hereby corrected as shown below:

On the title page item [75] Inventors: should include the following names of additional inventors:

| | |
|---|---|
| Hiroshi KOBAYASHI | Yoshiharu UEDA |
| Atsumi KAMINASHI | Masamichi YAMAMOTO |
| Keiryo TOU | Seikan ISHIGAI |

Column 3, line 16, "(16)" (first occurrence) should read -- (6) --.

Column 3, lines 39-42, corresponding to the following sentences, should be deleted in their entirety and inserted between lines 26-27.

-- A represents a conventional boiler which has no heat absorption water tube in the furnace.

B represents an example of the present invention which has heat absorption water tubes in the furnace. --

Column 5, line 46, "2.6" should read -- 2.0 --.

Column 6, line 59, "superheater water" should read -- superheater, water --.

UNITED STATES PATENT AND TRADEMARK OFFICE

CERTIFICATE OF CORRECTION

PATENT NO. : 5,020,479

DATED : June 4, 1991

INVENTOR(S) : Yasuhiko Suesada et al

It is certified that error appears in the above-identified patent and that said Letters Patent is hereby corrected as shown below:

In Figure 5, the description "Superheated water for conventional heat transfer economizer" should read --Ordinary Boiler parts (Superheater, water tube bank and Economizer)--.

Signed and Sealed this

Third Day of March, 1992

*Attest:*

HARRY F. MANBECK, JR.

*Attesting Officer*

*Commissioner of Patents and Trademarks*